US007538070B2

(12) United States Patent
Iftime et al.

(10) Patent No.: US 7,538,070 B2
(45) **Date of Patent: *May 26, 2009**

(54) THERMOCHROMIC RECORDING MEDIUM

(75) Inventors: Gabriel Iftime, Mississauga (CA); Peter M. Kazmaier, Mississauga (CA); Kyra Ramirez, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 344 days.

This patent is subject to a terminal disclaimer.

(21) Appl. No.: 11/146,706

(22) Filed: Jun. 7, 2005

(65) Prior Publication Data

US 2006/0286481 A1 Dec. 21, 2006

(51) Int. Cl.
*B41M 5/28* (2006.01)
*B41M 5/32* (2006.01)

(52) U.S. Cl. ..... 503/201; 503/214; 503/218

(58) Field of Classification Search ..... None
See application file for complete search history.

(56) References Cited

U.S. PATENT DOCUMENTS

| | | | | |
|---|---|---|---|---|
| 3,561,269 | A | 2/1971 | Seitz | |
| 3,663,650 | A | 5/1972 | Juliano | |
| 3,878,263 | A | 4/1975 | Martin | |
| 3,994,988 | A | 11/1976 | Laurin | |
| 4,421,560 | A | 12/1983 | Kito et al. | |
| 4,425,161 | A | 1/1984 | Shibahashi et al. | |
| 4,523,207 | A | 6/1985 | Lewis et al. | |
| 4,601,588 | A | 7/1986 | Takahara et al. | |
| 4,717,710 | A | 1/1988 | Shimizu et al. | |
| 5,112,526 | A | 5/1992 | Kuroda | |
| 5,281,570 | A | 1/1994 | Hasegawa et al. | |
| 5,288,592 | A * | 2/1994 | Miyashita | 430/345 |
| 5,350,633 | A | 9/1994 | Sumii et al. | |
| 5,350,634 | A | 9/1994 | Sumii et al. | |
| 5,352,649 | A | 10/1994 | Shibahashi et al. | |
| 5,403,702 | A | 4/1995 | Miyashita | |
| 5,527,385 | A | 6/1996 | Sumii et al. | |
| 5,558,699 | A | 9/1996 | Nakashima et al. | |
| 5,688,592 | A | 11/1997 | Shibahashi et al. | |
| 5,883,043 | A | 3/1999 | Halbrook, Jr. et al. | |
| 5,932,318 | A | 8/1999 | Uchiyama | |
| 6,048,387 | A | 4/2000 | Shibahashi et al. | |
| 6,365,312 | B1 * | 4/2002 | Foucher et al. | 430/108.21 |
| 6,562,755 | B1 | 5/2003 | Halbrook, Jr. et al. | |
| 6,803,344 | B2 | 10/2004 | Halbrook, Jr. et al. | |
| 7,214,456 | B2 * | 5/2007 | Iftime et al. | 430/19 |
| 7,316,875 | B2 * | 1/2008 | Iftime et al. | 430/19 |
| 2003/0002428 | A1 | 1/2003 | Cheong et al. | |
| 2004/0014396 | A1 | 1/2004 | Elledge | |
| 2004/0077743 | A1 | 4/2004 | Senga et al. | |
| 2004/0198600 | A1 | 10/2004 | Halbrook, Jr. et al. | |

OTHER PUBLICATIONS

"Effects of metal io complexation of the spiropyran-merocyanine interconversion: development of a thermally stable photo-switch", James T. Wojtyk et al., Chem. Common, 1703 (1986).*

* cited by examiner

*Primary Examiner*—Bruce H Hess
(74) *Attorney, Agent, or Firm*—Eugene O. Palazzo; Fay Sharpe LLP

(57) ABSTRACT

A thermochromic reimageable recording medium comprises a substrate and thermochromic composition comprising a photochromic material, a transition metal salt and a binder. The thermochromic composition changes color from a colorless state to a colored state upon application of heat. The thermochromic recording medium may be used to display a viewable image by applying heat to selected areas of the medium to form a desired image. The colored state is changeable or erasable back to the colorless state by exposure to visible light.

19 Claims, No Drawings

THERMOCHROMIC RECORDING MEDIUM

BACKGROUND

The present disclosure relates in various exemplary embodiments to thermochromic reimageable recording medium, e.g., thermal paper. More particularly, the present disclosure relates to a reimageable recording medium comprising a thermochromic composition that allows a visible image to be formed as desired by the application of heat to selected areas of the medium. The present disclosure also relates to a method for forming an image using such thermochromic reimageable recording medium.

Paper documents are often promptly discarded within a relatively short time after being read. Although paper is inexpensive, the quantity of discarded paper documents is enormous and the disposal of these discarded paper documents raises significant cost and environmental issues. Thus, it is desirable to provide a recording medium that is reusable and/or reimageable.

One method for providing a reimageable recording medium is to provide a recording medium coated with a photochromic material. Photochromic materials change from a colorless to a colored state when exposed to ultraviolet light. Copending application Ser. Nos. 10/835,518 and 10/834,722 are respectively directed to a reimageable recording medium comprising a photochromic material and a method for forming an image using such a reimageable recording medium. Some examples of known photochromic materials include spiropyrans and spiroxazines. Upon exposure to ultraviolet light, the closed ring structures, which exists in a colorless state, open and exhibit a colored state. The formulas below depict the closed and open states of a spiropyran and spiroxazine, respectively.

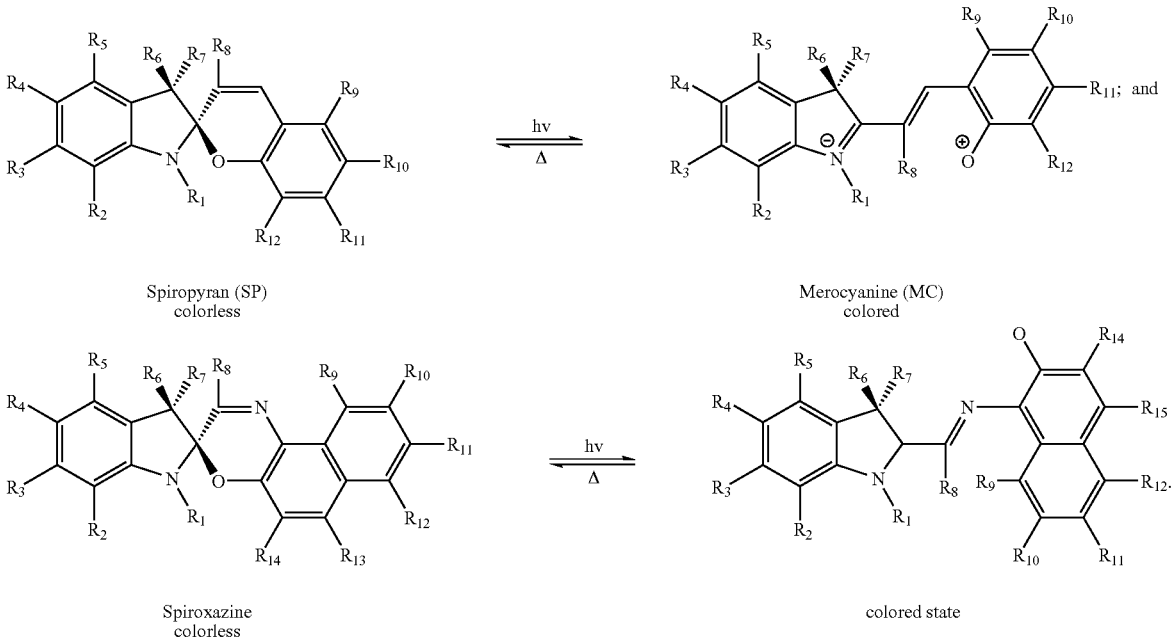

The above materials return to a colorless state by heating or by exposure to visible light. The stability of the colored state of spiropyrans has been shown to be enhanced by the addition of $ZnCl_2$ to a spiropyran compound in solutions. See "Effects of metal ion complexation of the spiropyran-merocyanine interconversion: development of a thermally stable photo-switch," James T. C. Wojtyk et al., *Chem. Common,* 1703 (1998).

Another option is to form a thermochromic recording medium, i.e., thermal paper, by use of a thermochromic material. Thermochromic materials change color upon exposure to heat. U.S. Pat. No. 5,403,702 is directed to an indolino spirobenzo pyran derivative described as being suitable for use as a thermochromic and photochromic material. Other patents and/or published applications disclosing the use of thermochromic materials and/or thermal paper include, for example, U.S. Pat. Nos. 3,561,269; 4,421,560; 4,425,161; 4,523,207; 4,601,588; 4,717,710; 5,112,526; 5,281,570; 5,350,633; 5,350,634; 5,352,649; 5,527,385; 5,558,699; 5,688,592; 5,883,043; 5,932,318; 6,562,755; 6,048,387; and 6,803,344, and U.S. Patent Application Publication Nos. 2003/0002428; 2004/0014396; 2004/0077743; and 2004/0198600.

There is still a need for a thermochromic reimageable recording medium comprising a thermochromic composition that exhibits a suitable color contrast. There is also a need for a thermochromic reimageable recording medium that is relatively. stable in dark conditions or in the absence of high intensity visible light.

BRIEF DESCRIPTION

The present disclosure relates, in various embodiments thereof, to a reimageable medium comprising a substrate, and a thermochromic composition, the thermochromic composition comprising a photochromic material selected from the group consisting of a spiropyran and a spiroxazine, and a transition metal halide.

Other aspects of the present disclosure, in embodiments thereof, include a method for forming an image comprising (a) providing a reimageable medium comprising a substrate and a thermochromic composition, the thermochromic composition (i) comprising a photochromic material selected from the group consisting of a spiropyran and a spiroxazine, and a transition metal halide, and (ii) being capable of exhibiting a colorless and a colored state; and (b) exposing the medium at selected locations to a temperature sufficient to change the exposed areas from a colorless to a colored state, thereby forming a colored image.

Still other aspects of the present disclosure, in embodiments thereof, include a reimageable medium comprising a substrate; and a thermochromic composition comprising (i) a photochromic material selected from the group consisting of a spiropyran and a spiroxazine, and (ii) a transition metal halide, wherein the medium is capable of exhibiting a color contrast upon exposing selected areas of the medium to an amount of heat sufficient to change the thermochromic composition from a colorless state to a colored state.

DETAILED DESCRIPTION

The present disclosure relates to a thermochromic reimageable recording medium. A thermochromic reimageable recording medium includes a substrate and a thermochromic composition. The thermochromic composition is capable of changing color states, such as from a colorless or invisible color state to a colored state upon exposure to heat such that a viewable image may be formed on the recording medium.

In embodiments, the substrate is made of a flexible material. The substrate can be transparent or opaque. The substrate may be composed of any suitable material such as wood, plastics, paper, fabrics, textile products, polymeric films, inorganic substrates such as metals, and the like. The plastic may be for example a plastic film, such as polyethylene film, polyethylene terepthalate, polyethylene napthalate, polystyrene, polycarbonate, polyethersulfone, and the like. The paper may be for example plain papers such as XEROX® 4024 papers, ruled notebook paper, bond paper, silica coated papers such as Sharp Company silica coated paper, Jujo paper, and the like. The substrate may be a single layer or multi-layer where each layer is the same or different material. The substrate may have a thickness as selected for a particular purpose or intended use. In embodiments, the substrate has a thickness in the range of, for example, from about 0.3 mm to about 5 mm.

In embodiments, the substrate (and reimageable medium) has any number of sides such as two (e.g., a sheet of paper), three, four or more sides (e.g., a cube). When one is trying to determine the number of sides of the substrate/medium, it is helpful to consider the intended use of the medium. For example, where the substrate/medium has the configuration of a folder (of the kind for holding loose papers) but the folder is laid relatively flat when viewing the temporary image which stretches across the entire viewing surface, the substrate/medium can be thought of as having two sides (front and back sides). In embodiments, the side can have a curved shape. It is understood that the number of reimageable sides of the medium may be the same as or fewer than the number of sides of the substrate. For example, where the substrate is a sheet of paper and the thermochromic material is present only on one side of the paper, then the reimageable medium has only one reimageable side even though the substrate is two-sided.

The color of the substrate may be selected as desired for a particular purpose or intended use. In embodiments, the substrate has a light color, such as, for example, a white color, on any number of sides such as on one side or on two sides or on all sides.

The substrate medium may be rigid or flexible. In fact, the substrate may have any suitable rigidity or flexibility depending on the intended use for the reimageable medium. In embodiments, the substrate is capable of undergoing a number of cycles of being rolled up/folded and then unrolled/unfolded. The substrate medium has any suitable size such as the dimensions of a business card, the dimensions of a sheet of paper (e.g., A4 and letter sized), or larger, and the like. The substrate medium may have any suitable shape such as planar (e.g., a sheet) or non-planar (e.g., cube, scroll, and a curved shape). In embodiments, a plurality of reimageable mediums can also be combined to form a larger reimageable surface analogous to a giant display screen composed of a number of smaller display screens.

The reimageable medium optionally includes a protective material which may reduce chemical degradation of the components of the reimageable medium due to exposure to ambient conditions, especially any chemical reaction involving the thermochromic material and oxygen. In embodiments, the protective material may also reduce physical deterioration of the reimageable medium due to for example handling and/or scratching. The protective material may be a transparent resin including for example polyvinyl alcohol, polycarbonate, or acrylic resin, or a mixture thereof. The protective material may be in the form of a separate layer over the thermochromic material. In another embodiment, the protective material and the thermochromic material form a single layer over the substrate. In a further embodiment, the protective material and the thermochromic material are both impregnated or embedded into a porous substrate such as paper.

In embodiments where both a protective material and a light absorbing material are present in the reimageable medium, the protective material and the light absorbing material may be present in the same or different layer. If present in different layers, the protective material may be located over the light absorbing material or vice versa.

The thermochromic composition comprises a photochromic material and a transition metal salt such as a transition metal halide. The photochromic material is selected from a group consisting of spiropyrans and spiroxazines.

Suitable spiropyran materials include those materials of the formula:

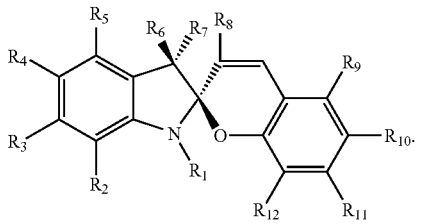

wherein $R_1$, $R_2$, $R_3$, $R_4$, $R_5$, $R_6$, $R_7$, $R_8$, $R_9$, $R_{10}$, $R_{11}$, and $R_{12}$ independently of the others can be (but are not limited to) hydrogen, alkyl, including cyclic alkyl groups, such as cyclopropyl, cyclohexyl, and the like, and including unsaturated alkyl groups, such as vinyl ($H_2C{=}CH{-}$), allyl ($H_2C{=}CH{-}CH_2{-}$), propynyl ($HC{\equiv}C{-}CH_2{-}$), and the like, having in embodiments from 2 to about 50 carbon atoms and, in other embodiments from 2 to about 30 carbon atoms, aryl, having in embodiments from about 6 to about 30 carbon atoms and in other embodiments from about 6 to about 20 carbon atoms, arylalkyl, having in embodiments from about 7 to about 50 carbon atoms and in other embodiments with from about 7 to about 30 carbon atoms, silyl groups, nitro groups, cyano groups, halide atoms, such as fluoride, chloride, bromide, iodide, and astatide, amine groups, including primary, secondary, and tertiary amines, hydroxy groups, alkoxy groups, the alkoxy groups having in embodiments from 1 to about 50 carbon atoms and in other embodiments with from 1 to about 30 carbon atoms, aryloxy groups, having, in embodiments, from about 6 to about 30 carbon atoms and in other embodiments with from about 6 to about 20 carbon atoms, alkylthio groups, with, in embodiments from 1 to about 50 carbon atoms and in other embodiments with from 1 to about 30 carbon atoms, arylthio groups with, in embodiments from about 6 to about 30 carbon atoms and in other embodiments with from about 6 to about 20 carbon atoms, aldehyde groups, ketone groups, ester groups, amide groups, carboxylic acid groups, sulfonic acid groups, and the like. The alkyl, aryl, and arylalkyl groups can also be substituted with groups such as, for example, silyl groups, nitro groups, cyano groups, halide atoms, such as fluoride, chloride, bromide, iodide, and astatide, amine groups, including primary, secondary, and tertiary amines, hydroxy groups, alkoxy groups, having embodiments from 1 to about 20 carbon atoms and in other embodiments from 1 to about 10 carbon atoms, aryloxy groups, having, in embodiments from about 6 to about 20 carbon atoms and in other embodiments from about 6 to about 10 carbon atoms, alkylthio groups, having embodiments from 1 to about 20 carbon atoms and in other embodiments from 1 to about 10 carbon atoms, arylthio groups, having, in embodiments, from about 6 to about 20 carbon atoms and in other embodiments, from about 6 to about 10 carbon atoms, aldehyde groups, ketone groups, ester groups, amide groups, carboxylic acid groups, sulfonic acid groups, and the like. Further, two or more R groups (that is, $R_1$ through $R_{12}$) can be joined together to form a ring.

Examples of spiropyrans include spiro[2H-1-benzopyran-2,2'-indolines], include, but are not limited to, those of the general formula I wherein substituents can be present on one or more of the 1', 3', 4', 5', 6', 7', 3, 4, 5, 6, 7, and 8 positions, spiroindolinonaphthopyrans, those of the general formula II, wherein substituents can be present on one or more of the 1, 3, 4, 5, 6, 7, 1', 2', 5', 6', 7', 8', 9' or 10' positions azaspiroindolinopyrans, those of the general formula III, wherein substituents can be present on one or more of the 3, 4, 5, 6, 7, 3', 4', 5', 6', 7', 8', and 9' positions.

I

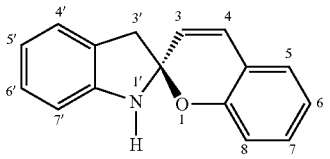

II

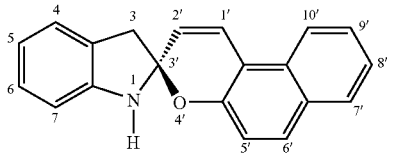

-continued

III

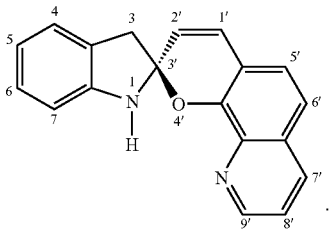

In embodiments, the photochromic material is a spiropyran of the formula:

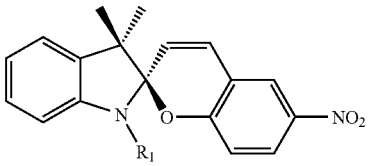

wherein $R_1$ is any suitable substituent as previously described herein. In one embodiment, the photochromic material is a spiropyran of the formula:

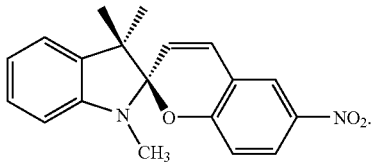

Suitable spiroxazines include those materials of the general formula:

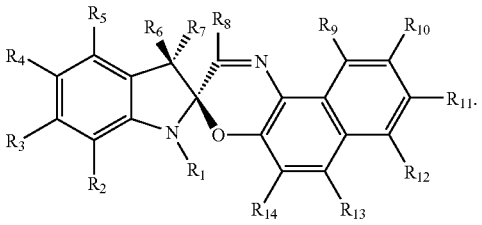

The R groups in the above spiroxazine formula may be any of those substituents previously described herein with respect to the spiropyrans.

Examples of spiroxazines are spiro[indoline-2,3'-[3H]-naphtho[2,1-b]-1,4-oxazines], including, but are not limited to, those of the general formula IV, wherein substituents can be present on one or more of the 1, 3, 4, 5, 6, 7, 1', 2', 5', 6', 7', 8', 9', or 10' positions, and the like.

IV

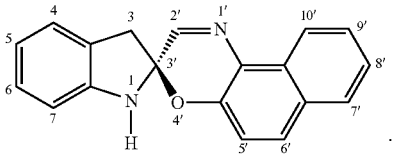

In embodiments, the photochromic material is a spiroxazine of the general formula:

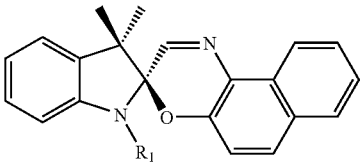

wherein $R_1$ is any suitable substituent as previously described herein. In one embodiment, the photochromic material is a spiroxazine of the formula:

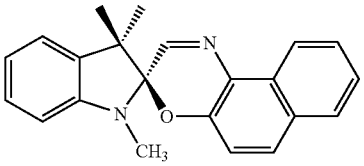

In embodiments the spiropyran and spiroxazine may be bonded to a polymer chain, forming a polymeric photochromic compound. In this case, the polymer binder is provided by the polymeric chain. Addition of a polymer binder is optional.

A polymeric photochromic compound may be obtained either by post functionalization of a polymer containing reactive groups or by first synthesizing a monomer containing the photochromic compound, followed by polymerization in the presence of an initiator.

In embodiments the spiropyran and spiroxazine may be bonded to a polymer particle. The polymer particle may be made of any suitable polymer which provides functional groups needed for chemically bonding the photochromic compound. Suitable functional groups include but are not limited to —OH, —OR, —COOH, —$SO_3H$, —$NH_2$, —NHR and the like.

In embodiments the spiropyran and spiroxazine may be bonded to an inorganic particle like silica, titania and the like. Untreated inorganic particles contain —OH groups. Surface treated inorganic particles may contain other functional groups like for example —$NH_2$ or —COOH.

Polymer and inorganic particles may be of size from a few nanometer up to about tens of microns.

When the photochromic compound is chemically bonded, at least one of the available positions in the photochromic compound is substituted by at least one functional group which reacts with a complementary functional group present on the polymer chain or particle. Suitable functional groups present on the photochromic compound include but are not limited to —OH, —OR, —COOH, —$SO_3H$, —$NH_2$, —NHR and the like.

The photochromic compound is attached to the polymer chain or the particles by chemical reaction between a functional group present on the polymer or the particle and a functional group present on the photochromic compound. For example, when the silica particle contains an —OH group and the spiropyran contains a —COOH group, the chemical bond is formed by a condensation reaction which results in an ester group, forming Spiropyran-COO-Titania.

The transition metal salts are formed from a transition metal ion and a counterion. The transition metal salts may include any of the transition metals including one or more transition metal atoms from the elements in Groups III B, IV B, V B, VII B, VIII B, I B, and II B of the periodic table. Examples of suitable transition metals include, but are not limited to, scandium, titanium, vanadium, chromium, manganese, iron, cobalt, nickel, copper, zinc, yttrium, zirconium, niobium, molybdenum, technetium, ruthenium, radium, palladium, silver, cadmium, hafnium, tantalum, tungsten, rhenium, osmium, iridium, platinum, gold, mercury, actinium, or the like. The transition metal may have any suitable oxidative state for that metal. In embodiments, the transition metal is in a +2 oxidation state and is selected from the group of zinc, copper, titanium, vanadium, chromium, iron, manganese, cobalt, nickel, and cadmium. The counterion which may be for example a halide including, for example, bromide, chloride, iodide, and fluoride, suphate, carbonate, nitrate and the like. In one embodiment, the transition metal halide is zinc chloride ($ZnCl_2$). Coordination transition metal complexes are also suitable. Examples of such salts include $ZnCl_2$ [$(CH_3)_2$ N—$CH_2CH_2$—N$(CH_3)_2$], Zn(OOC—$CH_3)_2$, Zn(acrylate)$_2$, Zinc(cycloheylybutyrate)$_2$, Copper(II)(gluconate)$_2$, Copper(II)(acetylacetonate)$_2$, Zn(acetylacetonate)$_2$, Zn(hexafluoroacetylacetonate)$_2$, Copper(II)(nitrate)$_2$ and, the like.

Upon exposure to an appropriate degree of heat, a thermochromic composition in accordance with the present disclosure comprising a photochromic material and a metal halide changes from a colorless state to a colored state. As used herein, the term "colorless state" refers to a state wherein the thermochromic composition is invisible or there is an absence of contrast relative to the substrate. As used herein, the term "colored state" refers to a visible state as evidenced by a color contrast relative to the substrate or other imaged areas. The color contrast to render the temporary image visible to an observer can be a contrast between, for example, two, three, or more different colors. The term "color" encompasses a number of aspects, such as hue, lightness, and saturation where one color can be different from another color if the colors differ in at least one aspect. For example, two colors having the same hue and saturation but are different in lightness would be considered different colors. Any suitable colors (e.g., red, black, blue, white, gray, yellow, orange, purple, and the like) may be used to produce the color contrast as long as the temporary image is visible to the naked eye. The term "color contrast" encompasses any degree of color contrast sufficient to render a temporary image discernable to an observer regardless of whether the color contrast changes or remains constant during the visible period. In embodiments, the color contrast can include, but are not limited to, an orange temporary image on a white background; and a dark blue temporary image on a white background.

Without being bound to any particular theory, the colored state is formed when, upon exposure to heat, the closed form of the photochromic material opens and forms a complex with the transition metal center of the metal halide. The thermochromic composition is capable of returning to a colorless state and does so upon exposure to visible light. While the previously mentioned Wojtyk et al. reference disclosed complexed spiropyrans-merocyanines, the colored state was achieved by illumination with UV light and not with heat as described herein.

For example, a thermochromic composition comprising a spiropyran material and $ZnCl_2$ is believed to change from a colorless to a colored state as follows:
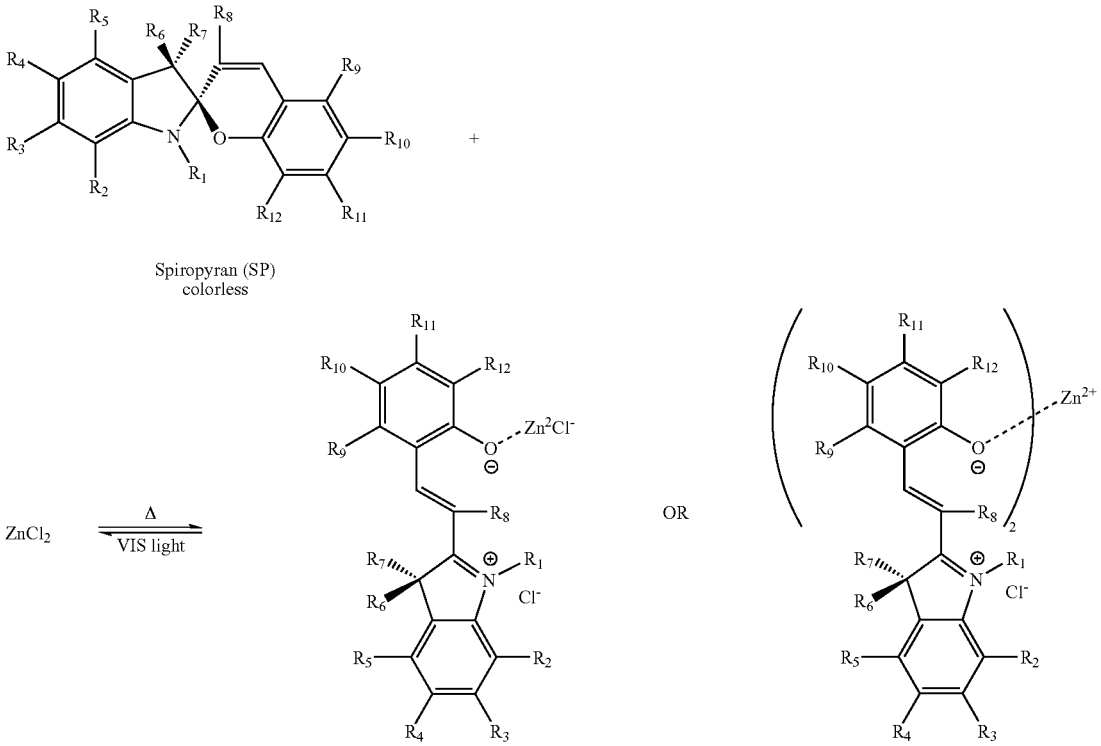
and a thermochromic composition comprising a spiroxazine and $ZnCl_2$ is believed to change from a colorless to a colored state as follows
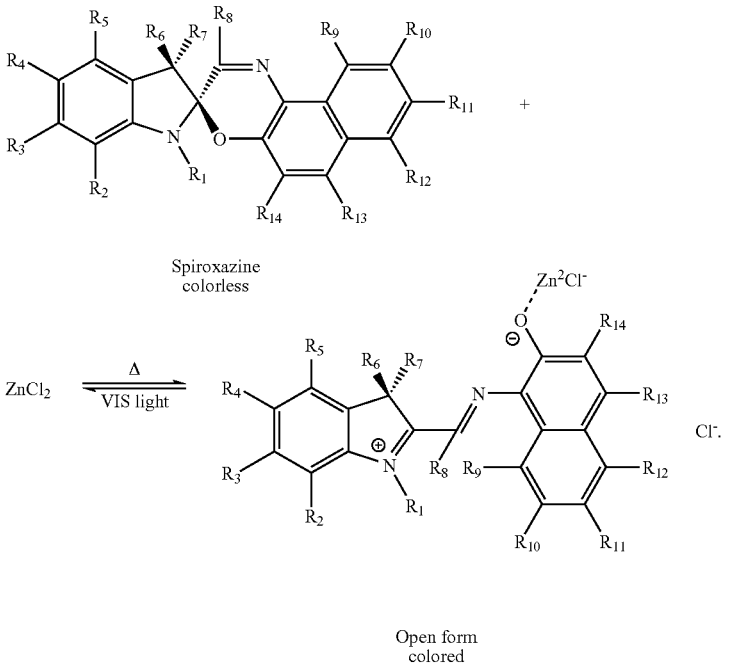

In the colored state, a thermochromic composition in accordance with the present disclosure is relatively stable in the dark. The period of time required to return the thermochromic composition from the colored state to the colorless state depends on several factors including, the amount of photochromic material in the thermochromic composition, and the intensity of the visible light. The visible time for a temporary image ranges in embodiments from about 1 hour to about 7 days. In other embodiments, the visible time for the temporary image ranges from about 3 to about 24 hours. The visible time is the time period during which a temporary image is desirable to the naked eye.

The color of a thermochromic composition depends on the photochromic material employed in the thermochromic composition, the transition metal salt, as well as the concentrations of the photochromic material and transition metal salt in the thermochromic composition. Similarly the optical density for the colored state and the light or colorless state and the contrast ratio also depend on the specific materials and concentrations employed in a thermochromic composition. In embodiments, the contrast ratio between the colored state and the colorless state is at least about 5. In other embodiments, the contrast ratio is at least about 25. In still other embodiments, the contrast ratio is at least about 50.

The concentration of the photochromic material the transition metal salt and polymer binder may be selected as desired for a particular purpose or intended use. In embodiments, a thermochromic composition comprises a photochromic material in an amount of from about 0.1% to about 30% percent by weight, and a metal halide in an amount of from about 0.1% to about 30% percent by weight. The ratio (weight/weight) between the photochromic compound and the metal salt is from about 0.01/1 to about 100/1.

A binder is optionally present. The role of the binder is that of a suspending medium to hold the thermochromic material as a film or layer on the substrate of interest. The desired properties of the binder are any or all of the following: mechanical flexibility, robustness, and optical clarity. In embodiments, the binder should not be highly crystalline or light scattering so that the temporary images are of sufficient contrast. Moreover, in embodiments, the binder is a solid, nonvolatile material that will not be removed from the substrate.

Any suitable binder may be used such as a polymer material. Examples of polymer materials that can be used as binders include, but are not limited to, polycarbonates, polystyrenes, polysulfones, polyethersulfones, polyarylsulfones, polyarylethers, polyolefins, polyacrylates, polyvinyl derivatives, cellulose derivatives, polyurethanes, polyamides, polyimides, polyesters, silicone resins, and epoxy resins and the like. Copolymer materials such as polystyrene-acrylonitrile, polyethylene-acrylate, vinylidenechloride-vinylchloride, vinylacetate-vinylidene chloride, styrene-alkyd resins are also examples of suitable binder materials. The copolymers may be block, random, or alternating copolymers.

Examples of polycarbonates as the binder include, but are not limited to, poly(bisphenol-A-carbonate) and polyethercarbonates obtained from the condensation of N,N'-diphenyl-N,N'-bis(3-hydroxyphenyl)-[1,1'-biphenyl]-4,4'-diamine and diethylene glycol bischloroformate.

Examples of polystyrenes as the binder include, but are not limited to, polystyrene, poly(bromostyrene), poly(chlorostyrene), poly(methoxystyrene), poly(methylstyrene) and the like.

Examples of polyolefins as the binder include, but are not limited to, polychloroprene, polyethylene, poly(ethylene oxide), polypropylene, polybutadiene, polyisobutylene, polyisoprene, and copolymers of ethylene, including poly (ethylene/acrylic acid), poly(ethylene/ethyl acrylate), poly (ethylene/methacrylic acid), poly(ethylene/propylene), poly (ethylene/vinyl acetate), poly(ethylene/vinyl alcohol), poly (ethylene/maleic anhydride) and the like.

Examples of polyacrylates as the binder include, but are not limited to, poly(methyl methyacrylate), poly(cyclohexyl methacrylate), poly(n-butyl methacrylate), poly(sec-butyl methacrylate), poly(iso-butyl methacrylate), poly(tert-butyl methyacrylate), poly(n-hexyl methacrylate), poly(n-decyl methacrylate), poly(lauryl methacrylate), poly(hexadecyl methacrylate), poly(isobornyl methacrylate), poly(isopropyl methacrylate), poly(isodecyl methacrylate), poly(isooctyl methacrylate), poly(noeopentyl methacrylate), poly(octadecylmethacrylate), poly(octyl methacrylate), poly(n-propyl methacrylate), poly(phenyl methacrylate), poly(n-tridecyl methacrylate), as well as the corresponding acrylate polymers. Other examples include: poly(acrylamide), poly (acrylic acid), poly(acrylonitrile), poly(benzylacrylate), poly (benzylmethacrylate), poly(2-ethylhexyl acrylate), poly (triethylene glycol dimethacrylate). Commercial examples of these materials include, but are not limited to, acrylic and methacrylic ester polymers such as ACRYLOID™ A10 and ACRYLOID™ B72, polymerized ester derivatives of acrylic and alpha-acrylic acids both supplied by the Rohm and Haas Company, and LUCITE™ 44, LUCITE™ 45 and LUCITE™ 46 polymerized butyl methacrylates supplied by the Du Pont Company.

Examples of polyvinyl derivatives as the binder include, but are not limited to, poly(vinyl alcohol), poly(vinyl acetate), poly(vinyl chloride), poly(vinyl butyral), poly(vinyl fluoride), poly(vinyl pyridine), poly(vinyl pyrrolidone), poly (vinyl stearate). Commercially available polyvinyl derivatives include chlorinated rubber such as PARLON™ supplied by the Hercules Powder Company; copolymers of polyvinyl chloride and polyvinyl acetate such as Vinylite VYHH and VMCH manufactured by the Bakelite Corporation; alkyd resins such as GLYPTAL™ 2469 manufactured by the General Electric Co.

Examples of cellulose derivatives as the binder include, but are not limited to, cellulose, cellulose acetate, cellulose acetate butyrate, cellulose propionate, cellulose triacetate, ethyl cellulose, hydroxypropyl cellulose, methyl cellulose, the like.

Examples of polyurethanes as the binder include, but are not limited to, aliphatic and aromatic polyurethanes like NEOREZ™ 966, NEOREZ™ R-9320, and the like, manufactured by NeoResins Inc., copolymers of polyurethanes with polyethers and polycarbonates like THECOTHANE®, CARBOTHANE®, TECHOPHYLIC® manufactured by Thermadics in Wilmington, Mass. (USA), BAYDUR® and BAYFIT®, BAYFLEX® and BAYTEC® polyurethane polymers manufactured by Bayer.

Examples of polyamides as the binder include, but are not limited to, Nylon 6, Nylon 66, TACTEL™ which is a registered mark of DuPont, modified polyamides like ARLEN™ from Mitsui Chemicals and TORLON®.

Examples of polyesters as the binder include, but are not limited to, poly(ethylene terepthalate), poly(ethylene napthalate), and the like.

Examples of silicone resins as the binder include, but are not limited to, polydimethylsiloxane, DC-801, DC804, and DC-996, all manufactured by the Dow Corning Corp. and SR-82, manufactured by GE Silicones. Other examples of silicone resins include copolymers, such as silicone polycarbonates, that can be cast into films from solutions in methylene chloride. Such copolymers are disclosed in U.S. Pat. No.

3,994,988. Other examples of silicone resins include siloxane modified acrylate and methacrylate copolymers described in U.S. Pat. Nos. 3,878,263 and 3,663,650. Methacryl silanes such as COATOSIL® 1757 silane, SILQUEST®A-174NT, SILQUEST®A-178, and SILQUEST®Y-9936 and vinyl silane materials such as COATOSIL® 1706, SILQUEST® A-171, and SILQUEST®A-151 all manufactured by GE-Silicones. Also, solvent-based silicone coatings such as UVHC3000, UVHC8558, and UVHC8559, also manufactured by GE-Silicones. Aminofunctional silicones may be combined with other polymers to create polyurethanes and polyimides. Examples of aminofunctional silicones include DMS-A11, DMS-A12, DMS-A15, DMS-A21, and DMS-A32, manufactured by Gelest Inc. Silicone films can also be prepared via RTV addition cure of vinyl terminated polydimethylsiloxanes, as described by Gelect Inc. The following formulation may be used:

DMS-V31 1000 cSt vinyl terminated polydimethylsiloxane—100 parts;

SIS6962.0 hexamethyldisilazane treated silica—50 parts;

MHS-301 methylhydrosiloxane-dimethylsiloxane copolymer—3 to 4 parts; and

SIP6830.0 platinum complex solution—150 to 200 ppm.

Another example of silicone-based coating binders is a cured elastomer derived from the SYLGARD® line of silicone materials. Examples of such materials include SYLGARD® 182 SYLGARD® 184 and SYLGARD® 186, available from Dow Corning.

Examples of epoxy resins as the binder include, but are not limited to, cycloaliphatic epoxy resins and modified epoxy resins like, for example, Uvacure 1500 series manufactured by Radcure Inc.; bisphenol-A based epoxy resins like for example D.E.R. 661, D.E.R. 671 and D.E.R. 692H all available at Dow Corning Company. Other examples include aromatic epoxy acrylates like LAROMER™ EA81, LAROMER™ LR 8713 and LAROMER™ LR9019, and modified aromatic epoxy acrylate like LAROMER™ LR 9023, all commercially available at BASF.

A binder material may optionally be present in the thermochromic composition an amount from about 30% to about 95% percent by weight of the thermochromic composition. The binder may be composed of one, two, three or more different binders. When two or more different binders are present, each binder may be present in an equal or unequal amount by weight ranging for example from about 5% to 90% based on the weight of al binders. In embodiments, each binder may be present in an amount of from about 30% to about 50%, based on the weight of all binders.

A thermochromic composition may be formed by any suitable manner, including, for example, dissolving and mixing the photochromic material, the metal halide and optionally the binder together. A solvent may be used to dissolve the photochromic material, the transition metal salt and the optional binder, to enable processing to create for example a uniform film coating on the substrate. In embodiments, the solvent is volatile enough so that it can be conveniently removed during drying. Water may be used as a solvent for water soluable binders such as poly(vinyl alcohol) and water soluble photochromic and light absorbing materials. Other solvents that may be used include halogenated and nonhalogenated solvents, such as tetrahydrofuran, trichloro- and tetrachloroethane, dichloromethane, chloroform, monochlorobenzene, toluene, xylenes, acetone, methanol, ethanol, xylenes, benzene, ethyl acetate and the like. The solvent may be composed of one, two, three or more different solvents. When two or more different solvents are present, each solvent may be present in an equal or unequal amount by weight ranging for example from about 5% to 90%, particularly from about 30% to about 50%, based on the weight of all solvents.

A reimageable recording medium may also include a UV absorbing material. A thermochromic composition in accordance with the present disclosure may exhibit some coloration when exposed to UV light given the fact that a thermochromic composition in accordance with the present disclosure comprises a photochromic material. The efficiency of coloration with UV light, however, is much lower than the efficiency of coloration obtained by heating. A UV absorbing material, which is a material that absorbs all incident UV light from the ambient light, is applied so that the thermochromic composition does not exhibit any undesired coloration due to UV light. Examples of suitable UV absorbing materials include, but are not limited to commercially available for example at Mayzo (BLS®531; BLS®5411; BLS®1710), Ciba (TINUVIN®234, TINUVIN® P, TINUVIN® 1577) and are typically used as UV protective layer to prevent photochemical degradation of polymeric coatings products available from Ciba. Other suitable examples of UV absorbing materials include Lowilite® series available at Great Lakes Polymer Additives, such as benzotriazole UV absorbers, like for example, Lowilite® 26, Lowilite® 55 and others. Alternatively, they may be benzophenone absorbers similar to, for example, Lowilite®20, Lowilite®24 and the like.

Any suitable technique may be used to form the reimageable medium. For example, to deposit the components described herein, typical coating techniques include, but are not limited to, vacuum deposition, spin coating, dip coating, spray coating, draw bar coating, doctor blade coating, slot coating, roll coating and the like. After deposition, solvent can be removed by drying for a time ranging for example from about 5 minutes to about 20 hours. Drying of the deposited coating can be effected by any suitable drying techniques or a combination of them. Suitable drying techniques include air drying, air impingement drying, oven drying, infra-red radiation drying and the like.

A thermosensitive reimageable recording medium may be used to form a desired viewable image on the medium. An image is formed on the medium by exposing selected areas of the medium to an appropriate temperature. In embodiments, an image is formed by heating a selected area of the medium to a temperature of at least about 100° C. thereby causing the thermochromic material to change from the colorless to a colored state to form a viewable image. Any suitable heat source may be used to apply the heat required to form a desired image. For example, heat may be applied by writing with a soldering iron tip or the like. A printing apparatus may also be used to apply the required heat to form a desired image. Thermal printers are well known and many have been in use for thermally printing permanent information on specially designed paper. They have been in use for example in fax machines and for printing receipts at cash registers, prior to laser printing technology. Heat is provided by a thermal head adjusted to the required temperature. The printing head scans the surface of the paper and touches it where the colored areas are to be printed. Some of the companies manufacturing thermal printers include Seiko and Panasonic.

In embodiments, a thermochromic reimageable medium has a contrast ratio for the colored or viewable image of at least about 10.

A thermosensitive recording medium is reimageable in that an image formed as described above may be erased upon exposure of the entire recording medium or selected areas of the medium to visible light. The rate of erasure depends upon the concentration of photochromic material in the thermochromic composition, the concentration and/or type of binder used in the thermochromic composition, and/or the intensity of visible light. After an image is erased as desired, the recording medium is ready to be reimaged by applying heat to selected areas as described above.

In embodiments of a reimageable medium, in accordance with the present disclosure a reimageable medium is capable of any suitable number of cycles of temporary image formation and temporary image erasure ranging for example from about 5 cycles to about 1,000 cycles, or from about 10 cycles to about 100 cycles, without significant chemical degradation of the thermochromic material and the other components. In embodiments of the present method, after undergoing the initial cycle of temporary image formation and temporary image erasure, the reimageable medium optionally undergoes a number of additional cycles of temporary image formation and temporary image erasure ranging from 1 additional cycle to about 1,000 additional cycles, or from about 3 additional cycles to about 1 additional cycles. When there is a plurality of cycles of temporary image formation and temporary image erasure, each temporary image may be the same or different from each other, and each temporary image may be present on the same or different from each other, and each temporary image may be present on the same or different region of the reimageable medium.

A thermochromic reimageable recording medium in accordance with the present disclosure is further described with reference to the following examples. The examples are for the purpose of further illustrating a thermochromic reimageable recording medium in accordance with the present disclosure and are not intended to be limiting embodiments thereof.

EXAMPLES

Example I

An active medium was spin coated on glass slides from a solution containing 50 mg of a spiropyran compound of the formula:

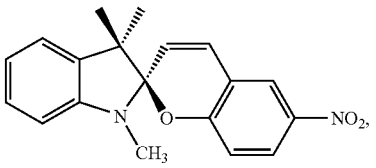

one equivalent of zinc chloride ($ZnCl_2$) and 0.625 grams of polymethyl methacrylate (PMMA) in 2.5 ml of tetrahydrofuran (THF) as a solvent.

The polymer film was heated at 100° C. in an oven for a few minutes. After heating, the sample became dark orange.

The film was allowed to self erase under ambient light conditions. Full erasure was achieved in a few hours. Faster erasure was obtained by illuminating the sample with visible light (greater than 450 nm) of high intensity from a xenon lamp with an appropriate cutoff filter.

Example II

A white paper medium was prepared by soaking the paper in a composition comprising 50 mg of the spiropyran compound used in Example I, three equivalents of zinc chloride, and 0.625 grams of PMMA in 2.5 ml of THF as a solvent.

Paper sheets containing the thermochromic composition were tested by heating at a temperature of 120° C. on a hot plate. The heated portion of the paper turned an orange color, while the unheated portion remained in a white colorless state. One paper sample was kept in the dark for about a week and no decay of the colored state was observed.

The thermochromic materials from Examples I and II can be switched to the colored state (orange in this case) by the use of high intensity UV light. The efficiency of coloration with UV light, however, is much lower as compared to the coloration obtained by heating. This indicates that the document and the thermochromic composition have a relatively reduced sensitivity to the UV component of ambient room light. In other known transient documents, compositions exhibiting too high a sensitivity for the UV component of ambient room light were a serious problem because white areas became colored in time, which decreased the contrast between the colored and the colorless or white states and decreases the quality of the printed information.

Example III

Active media was spin coated on glass slides from a thermochromic composition comprising 50 mg of a spiroxazine compound of the formula:

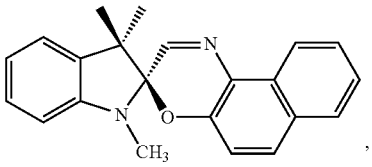

, three equivalents in zinc chloride, and 0.625 grams of PMMA in 2.5 ml of THF as a solvent.

The polymer film was heated at 100° C. in an oven for a few minutes, and the sample became dark blue. Full erasure of the dark blue colored state was achieved after a few hours under ambient light conditions.

The optical density of the dark and light states was measured. The optical density of the dark thermochromic colored state was 2.07, and the optical density for the white (colorless) state was 0.25. The results provide a contrast ratio of 66. A contrast ratio of higher than 10 is considered very good in any e-paper documents. High contrast ratios are important for high resolution devices.

Example IV

Paper sheets containing the reimageable recording media were prepared by soaking white paper with a thermochromic composition containing 50 mg of the spiroxazine compound utilized in Example III, three equivalents of zinc chloride, and 0.625 grams of PMMA in 2.5 ml of THF as a solvent.

Text was written on one of the prepared sheets by using heat provided from a soldering iron tip. The portions of the sheets heated with the soldering iron tip provided areas of the document with a dark blue colored state.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A reimageable medium comprising:

a substrate; and a thermochromic composition comprising a spiroxazine and a transition metal salt.

2. The reimageable medium according to claim 1, wherein the spiroxazine is of the formula:

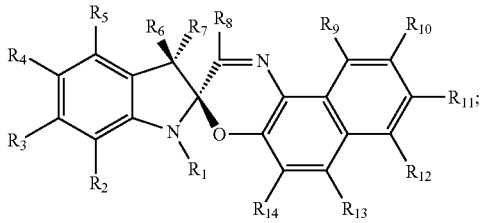

and $R_{1-14}$ are independently selected from alkyl and substituted alkyl groups with from 1 to about 50 carbon atoms, cyclic alkyl groups with from 3 to about 10 carbon atoms, unsaturated alkyl groups with 2 to about 50 carbon atoms, aryl and substituted aryl compounds with from about 6 to about 30 carbon atoms, arylalkyl and substituted arylalkyl compounds with from about 7 to about 50 carbon atoms, silyl groups, nitro groups, cyano groups, halide atoms, primary amines, secondary amines, tertiary amines, hydroxy groups, alkoxy groups with from about 6 to about 30 carbon atoms, alkylthio groups with 1 to about 50 carbon atoms, arylthio groups with from about 6 to about 30 carbon atoms, aldehyde groups, ester groups, amide groups, carboxylic acid groups and sulfuric acid groups.

3. The reimageable medium according to claim 2, wherein the spiroxazine is chemically bonded to a polymer chain.

4. The reimageable medium according to claim 2, wherein the spiroxazine is chemically bonded to a polymer particle.

5. The reimageable medium according to claim 1, wherein the spiroxazine is of the formula:

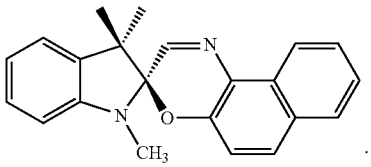

6. The reimageable medium according to claim 1, wherein the transition metal salt comprises a divalent transitional metal atom.

7. The reimageable medium according to claim 1, wherein the transition metal salt comprises a trivalent transitional metal atom.

8. The reimageable medium according to claim 1, wherein the transition metal salt is a coordination transition metal complexes selected from the group consisting of $ZnCI_2$ $[(CH_3)_2N—CH_2CH_2—N(CH_3)_2]$, $Zn(OOC—CH_3)_2$, Zn (acrylate)$_2$, Zinc(cyclohexylbutyrate)$_2$, Copper(II) (gluconate)$_2$, Copper(II)(acetylacetonate)$_2$, Zn(acetylacetonate)$_2$, Zn(hexafluoro acetylacetonate)$_2$, and Copper (II)(nitrate)$_2$.

9. The reimageable medium according to claim 1, wherein more than one metal salt is present.

10. The reimageable medium according to claim 1, wherein the transition metal salt is $ZnCl_2$, $ZnBr_2$ or $ZnI_2$.

11. The reimageable medium according to claim 1, further comprising a binder.

12. The reimageable medium according to claim 11, wherein the binder is a polymer which comprises at least one of PMMA, polycarbonates, polystyrenes, polysulfones, polyethersulfones, polyarylsulfones, polyarylethers, polyolefins, polyacrylates, polyvinyl derivatives, cellulose derivatives, polyurethanes, polyamides, polyimides, polyesters, silicone resins, epoxy resins, polyvinyl alcohol, polyacrylic acid and the like, copolymer materials.

13. The reimageable medium according to claim 1, wherein the substrate is selected from the group consisting of paper, plastic, and white paper.

14. The reimageable medium according to claim 1, wherein the thermochromic composition changes from a colorless state to a colored state when heated to a temperature of about 100° C. and above.

15. The reimageable medium according to claim 14, wherein the thermochromic composition changes from the colored state back to the colorless state, over time, upon exposure to at least one of ambient light and high intensity visible light.

16. The reimageable medium according to claim 15, wherein a rate of change from the colored state back to the colorless state increases as the intensity of the visible light increases.

17. A method for forming an image comprising:

(a) providing a reimageable medium comprising a substrate and a thermochromic composition forming a layer on the substrate, the thermochromic composition (i) comprising a photochromic material, a transition metal halide, and a binder, and (ii) being capable of exhibiting a colorless and a colored state; and (b) exposing the medium at selected locations to a temperature sufficient to change the exposed areas from a colorless to a colored state, thereby forming a colored image;

wherein the photochromic material is a spiroxazine of the formula:

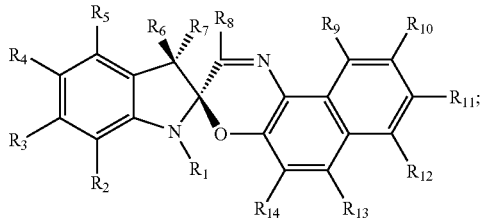

and $R_{1-14}$ are independently selected from alkyl and substituted alkyl groups with from 1 to about 50 carbon atoms, cyclic alkyl groups with from 3 to about 10 carbon atoms, unsaturated alkyl groups with 2 to about 50 carbon atoms, allyl containing compounds with 1 to about 50 carbon atoms, propynyl containing compounds with 1 to about 50 carbon atoms, aryl and substituted aryl compounds with from about 6 to about 30 carbon atoms, arylalkyl and substituted arylalkyl compounds with from about 7 to about 50 carbon atoms, silyl groups, nitro groups, cycno groups, halide atoms, primary amines, secondary amines, tertiary amines, hydroxy groups, alkoxy groups with from about 6 to about 30 carbon atoms, alkylthio groups with 1 to about 50 carbon atoms, arylthio groups with from about 6 to about 30 carbon atoms, aldehyde groups, ester groups, amide groups, carboxylic acid groups and sulfuric acid groups.

18. A reimageable medium comprising:

a substrate; and a thermochromic composition comprising a transition metal salt and a photochromic material selected from the group consisting of a spiropyran and a spiroxazine;

wherein the spiropyran is of the formula:

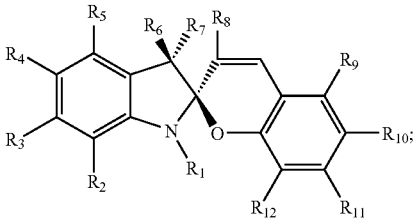

wherein $R_{1-12}$ are independently selected from alkyl and substituted alkyl groups with from 1 to about 50 carbon atoms, cyclic alkyl groups with from 3 to about 10 carbon atoms, unsaturated alkyl groups with 2 to about 50 carbon atoms, aryl and substituted aryl compounds with from about 6 to about 30 carbon atoms, arylalkyl and substituted arylalkyl compounds with from about 7 to about 50 carbon atoms, silyl groups, nitro groups, cyano groups, halide atoms, primary amines, secondary amines, tertiary amines, hydroxy groups, alkoxy groups with from about 6 to about 30 carbon atoms, alkylthio groups with 1 to about 50 carbon atoms, arylthio groups with from about 6 to about 30 carbon atoms, aldehyde groups, ester groups, amide groups, carboxylic acid groups and sulfuric acid groups;

wherein the spiroxazine is of the formula:

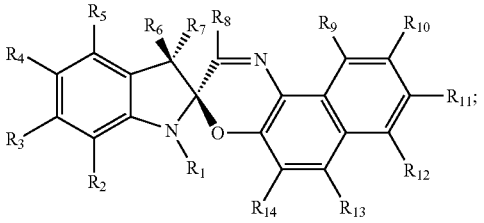

wherein $R_{1-14}$ are independently selected from alkyl and substituted alkyl groups with from 1 to about 50 carbon atoms, cyclic alkyl groups with from 3 to about 10 carbon atoms, unsaturated alkyl groups with 2 to about 50 carbon atoms, aryl and substituted aryl compounds with from about 6 to about 30 carbon atoms, arylalkyl and substituted arylalkyl compounds with from about 7 to about 50 carbon atoms, silyl groups, nitro groups, cyano groups, halide atoms, primary amines, secondary amines, tertiary amines, hydroxy groups, alkoxy groups with from about 6 to about 30 carbon atoms, alkylthio groups with 1 to about 50 carbon atoms, arylthio groups with from about 6 to about 30 carbon atoms, aldehyde groups, ester groups, amide groups, carboxylic acid groups and sulfuric acid groups; and wherein the photochromic material is chemically bonded to an inorganic particle.

19. The reimageable medium of claim 18, wherein the inorganic particle is silica or titania.

* * * * *